US010024627B2

(12) United States Patent
Pendleton

(10) Patent No.: US 10,024,627 B2
(45) Date of Patent: Jul. 17, 2018

(54) TACTICAL DEVICE

(71) Applicant: Bruce Pendleton, Loganville, GA (US)

(72) Inventor: Bruce Pendleton, Loganville, GA (US)

( * ) Notice: Subject to any disclaimer, the term of this patent is extended or adjusted under 35 U.S.C. 154(b) by 0 days.

(21) Appl. No.: 15/255,084

(22) Filed: Sep. 1, 2016

(65) Prior Publication Data

US 2017/0059270 A1 Mar. 2, 2017

Related U.S. Application Data

(60) Provisional application No. 62/213,502, filed on Sep. 2, 2015.

(51) Int. Cl.

| | |
|---|---|
| ***F41C 9/00*** | (2006.01) |
| ***F41A 19/13*** | (2006.01) |
| ***F41A 3/12*** | (2006.01) |
| ***F41A 3/66*** | (2006.01) |
| ***F41A 9/47*** | (2006.01) |
| ***F41A 17/20*** | (2006.01) |
| ***F41A 21/48*** | (2006.01) |
| ***F41A 35/04*** | (2006.01) |
| ***F41C 9/02*** | (2006.01) |
| ***F41C 9/04*** | (2006.01) |
| *F41A 21/10* | (2006.01) |

(52) U.S. Cl.

CPC ..... *F41C 9/00* (2013.01); *F41A 3/12* (2013.01); *F41A 3/66* (2013.01); *F41A 9/47* (2013.01); *F41A 17/20* (2013.01); *F41A 19/13* (2013.01); *F41A 21/487* (2013.01); *F41A 35/04* (2013.01); *F41C 9/02* (2013.01); *F41C 9/04* (2013.01); *F41A 21/10* (2013.01)

(58) Field of Classification Search

CPC . F41C 9/00–9/04; F41A 35/04; F41A 21/487; F41A 17/20; F41A 3/66; F41A 3/12; F41A 9/47; F41A 19/13; F41A 21/10; B25C 1/10–1/188

See application file for complete search history.

(56) References Cited

U.S. PATENT DOCUMENTS 2,512,998 A * 6/1950 Brock ..... F41C 9/02 42/106
2,634,535 A * 4/1953 Borders ..... F41B 15/02 42/1.08

(Continued)

FOREIGN PATENT DOCUMENTS

EP 0156061 A2 * 10/1985 ..... F41A 5/16
GB 696764 A * 9/1953 ..... F41C 9/00

*Primary Examiner* — Stephen Johnson
*Assistant Examiner* — Joshua T Semick
(74) *Attorney, Agent, or Firm* — Brient IP Law, LLC

(57) ABSTRACT

A tactical device has a barrel having a first end, a second end, and a through hole that extends between the first end and a second end. A barrel housing has a first end, a second end and a through hole that extends between the first end and the second end. The barrel second end is configured to be inserted into the barrel housing first end and is axially moveable with respect to the barrel housing. A firing pin is mounted in the barrel housing through hole proximate the barrel housing second end and has a protrusion that extends toward the barrel housing first end. The tactical device has a safety means for maintaining the barrel in a first position in which the firing pin is spaced apart from the barrel second end.

20 Claims, 9 Drawing Sheets

(56) References Cited

U.S. PATENT DOCUMENTS

| | | | | | |
|---|---|---|---|---|---|
| 3,707,794 | A * | 1/1973 | Rocha | F41A 19/39 | 42/1.08 |
| 3,824,727 | A * | 7/1974 | Hudson | F41C 9/02 | 42/1.09 |
| 4,268,987 | A * | 5/1981 | Cash | F41C 9/02 | 42/106 |
| 4,490,935 | A * | 1/1985 | Plachy | F41C 9/02 | 401/195 |
| 4,748,759 | A * | 6/1988 | Whiteing | F41C 9/00 | 42/1.09 |
| 5,791,327 | A * | 8/1998 | Riggs | F41A 19/18 | 124/56 |
| 8,739,447 | B2 * | 6/2014 | Merritt | F41G 11/004 | 362/110 |
| 8,919,023 | B2 * | 12/2014 | Merritt | F41G 11/004 | 42/70.01 |
| 2006/0005443 | A1 * | 1/2006 | Camp | F41B 11/62 | 42/1.08 |

* cited by examiner

TACTICAL DEVICE

CROSS REFERENCE TO RELATED APPLICATIONS

This application claims the benefit of U.S. Provisional Patent Application No. 62/213,502, filed Sep. 2, 2015, entitled "Tactical Device," which is incorporated herein by reference in its entirety.

BACKGROUND

The present invention relates generally to tactical devices and in particular to a tactical device that is configured to fire a cartridge, which consists of a case, primer, propellant and a projectile.

SUMMARY

In general, in various embodiments, a tactical device comprises (1) a barrel comprising, a first end, a second end having an opening formed therein, a first through hole that extends from the first end to the second end, a first outer diameter, a first inner diameter that defines the through hole, wherein a diameter of the opening is smaller than the first inner diameter of the through hole; (2) a barrel housing comprising a first end, a second end, and a second through hole that extends from the first end to the second end, wherein the second through hole has a second inner diameter that is larger than the first outer diameter of the barrel, and the barrel second end is inserted into the barrel housing first end and the barrel is axially moveable with respect to the barrel housing; (3) a firing pin mounted in the barrel housing second through hole proximate to the barrel housing second end, the firing pin having a protrusion that extends toward the barrel housing first end; (4) a safety mechanism comprising a safety recess formed in the outer circumferential surface of the barrel housing, an opening at the base of the safety recess that opens into the second through hole, a safety comprising (a) a safety disc, (b) a first stud extending from the safety disc, (c) a second stud extending from the safety disc, and (d) a spring; and (5) a safety cap moveably coupled to the second end of the barrel housing and moveable between a first safety off position and a second safety on position, wherein the safety cap comprises (a) a first end defining an opening there through, (b) a second end, (c) an inner circumferential surface that defines a sidewall of a blind bore from the opening, (d) a first flat surface formed in the inner circumferential surface of the safety cap that is formed at a first radial distance from a central axis that extends between the first end and the second end of the safety cap, and (e) a second flat surface formed in the inner circumferential surface of the safety cap that is formed at a second radial distance from the central axis that is larger than the first radial distance.

In various embodiments, the safety is received in the safety recess such that the second stud passes through the opening at the base of the safety recess. In some embodiments, the spring is positioned intermediate the safety disc and the safety recess such that the spring biases the safety disc radially outward of the safety recess. In particular embodiments, the barrel is moveable with respect to the barrel housing between (1) a first position in which the opening in the second end of the barrel is spaced apart from the protrusion on the firing pin, and (2) a second firing position in which the barrel is moved axially with respect to the barrel housing such that the firing pin protrusion extends through the opening in the second end of the barrel. In particular embodiments, the safety cap is moveable between a safety on first position in which the first flat surface engages with the first stud thereby pushing the safety radially inward such that the second stud is moved into the second through hole in the barrel housing thereby preventing the barrel from moving from the first position into the firing second position, and a second safety off position in which the second flat surface engages with the first stud thereby allowing the spring to bias the safety disc radially outward with respect to the safety recess so that the second stud exits the second through hole thereby allowing the barrel to move into the second firing position.

In another embodiment, a tactical device comprises (1) a barrel having a first end, a second end having an opening formed therein, a first through hole that extends from the first end to the second end, a first outer diameter; and a first inner diameter that defines the through hole, wherein a diameter of the opening is smaller than the first inner diameter of the through hole; (2) a barrel housing having a first end, a second end, and a second through hole that extends from the first end to the second end, wherein the second through hole has a second inner diameter that is larger than the first outer diameter of the barrel, and the barrel second end is inserted into the barrel housing first end and the barrel is axially moveable with respect to the barrel housing; and (3) a firing pin mounted in the barrel housing second through hole proximate to the barrel housing second end, the firing pin having a protrusion that extends toward the barrel housing first end. In particular embodiments, the barrel is moveable with respect to the barrel housing between (a) a first position in which the opening in the second end of the barrel is spaced apart from the protrusion on the firing pin, and (b) a second firing position in which the barrel is moved axially with respect to the barrel housing such that the firing pin protrusion extends through the opening in the second end of the barrel.

In yet another embodiment, a tactical device comprises (1) a barrel having a first end, a second end, a through hole that extends between the first end and a second and an outer diameter, wherein the second end is configured to removeably receive a cartridge in the barrel second end; (2) a barrel housing having a first end, a second end and a second through hole that extends between the first end and the second end, wherein the barrel housing has an inner diameter that is larger than the outer diameter of the barrel and the barrel second end is configured to be inserted into the barrel housing first end and axially moveable with respect to the barrel housing; (3) a firing pin mounted in the barrel housing through hole proximate the barrel housing second end, the firing pin having a protrusion that extends toward the barrel housing first end; and (4) a safety means for maintaining the barrel in a first position in which the firing pin is spaced apart from the barrel second end. In particular embodiments, the barrel is moveable with respect to the barrel housing between (a) a first position in which the opening in the second end of the barrel is spaced apart from the protrusion on the firing pin, and (b) a second firing position in which the barrel is moved axially with respect to the barrel housing such that the firing pin protrusion extends engages with a cartridge positioned in the barrel second end.

BRIEF DESCRIPTION OF THE DRAWINGS

Various embodiments of an apparatus, system, and method for firing a cartridge are described below. In the course of this description, reference will be made to the accompanying drawings, which are not necessarily drawn to scale, and wherein.

DETAILED DESCRIPTION

Various embodiments now will be described more fully hereinafter with reference to the accompanying drawings. It should be understood that the invention may be embodied in many different forms and should not be construed as limited to the embodiments set forth herein. Like numbers refer to like elements throughout.

Overview

The tactical device consists of a barrel housing and barrel that is chambered to a specific caliber cartridge, which may include any suitable caliber such as a .32 caliber, a .38 caliber, a .40 caliber, a .45 caliber, etc. The barrel is configured to allow a user to insert a cartridge at a second end and to secure the cartridge in the barrel using a barrel cap that is releasably secured on the barrel second end. The barrel cap has a through hole formed therein that allows a firing pin to strike the end of the cartridge. The firing pin is axially fixed proximate a second end of the barrel housing. Once the cartridge is secured in the second end of the barrel, the second end of the barrel containing the cartridge is loaded into a first end of the barrel housing. The barrel can be placed into a first (ready to fire) position in the barrel housing by pressing the barrel into the barrel housing while a barrel cap is in a safety on position. That is, before the second end of the barrel is inserted into the first end of the barrel housing, the user moves the barrel safety cap into a safety on position so that the second end of the barrel can be inserted into the first end of the barrel housing until the second end of the barrel abuts the safety pin. In the first position, the tactical device is loaded and is in a ready to fire position where the firing pin is proximate to but spaced apart from the end of the cartridge and prevented from striking the cartridge.

In order to discharge the tactical device, the user moves the safety cap into a safety off position so that the safety pin is moved out of the path of the barrel second end within the barrel housing. When the user depresses the first end of the barrel against an object (e.g. a body, a target or any other suitable object), the barrel slides axially relative to the barrel housing so that the barrel second end is forced toward the barrel housing second end such that the firing pin comes into contact with the end of the cartridge. The barrel moves into a second position (the fired position) as the barrel second end is forced toward the barrel housing second end. When the cartridge end is struck by the firing pin, the projectile in the cartridge is propelled out of the barrel first end toward the object.

First Embodiment of a Tactical Device

Figure 1:
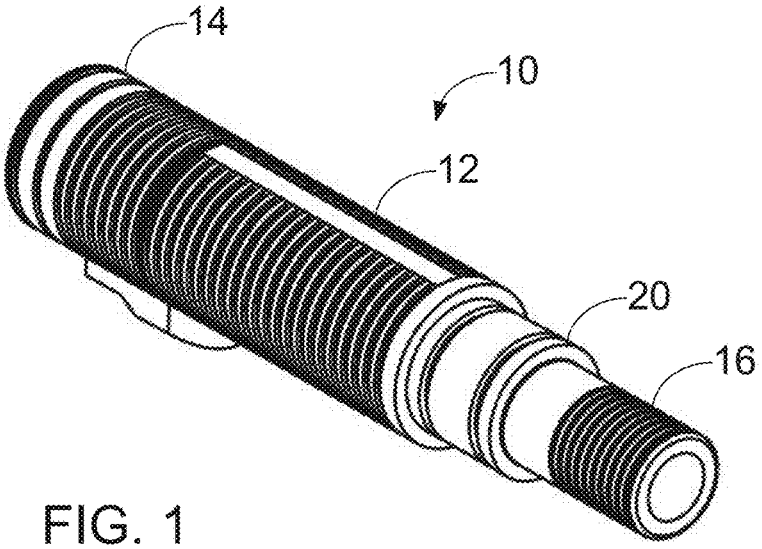
FIG. 1 is a perspective view of a tactical device in accordance with one embodiment of the present invention.
Figure 2:
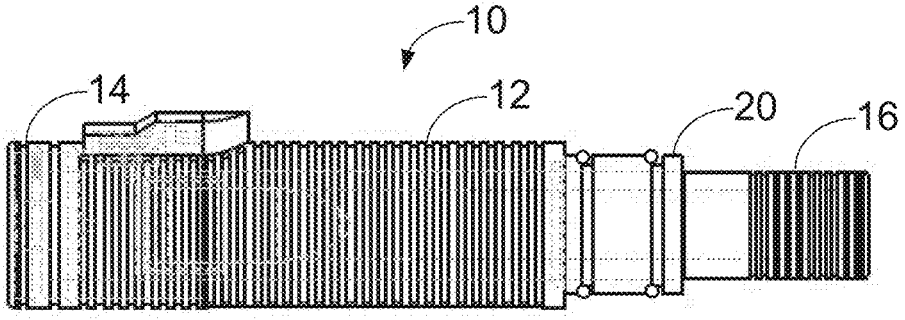
FIG. 2 is a side view of the tactical device of FIG. 1.
Figure 3:
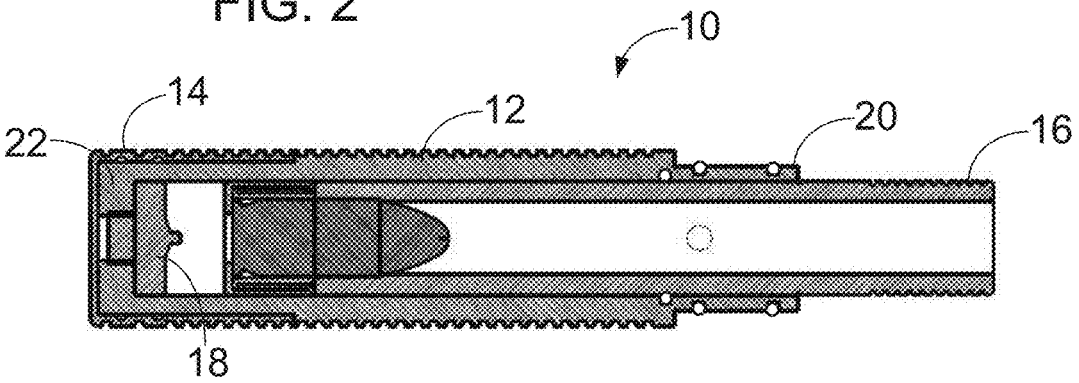
FIG. 3 is a cross-section view of the tactical device of FIG. 1.

Referring particularly to FIGS. 1-3, a tactical device 10 generally comprises a barrel housing 12, a safety cap 14 and a barrel 16. Referring particularly to FIG. 3, the tactical device 10 further comprises a firing pin 18. The barrel 16 is received in a first end 20 of the barrel housing 12 and the firing pin 18 is operatively coupled to a second end 22 (FIG. 3) of the barrel housing 12 and axially fixed therein by a suitable connection such as threads, pin, etc. Furthermore, the safety cap 14 is configured to at least partially receive at least a portion of the barrel housing second end 24. The safety cap 14 is configured to be moveably received over the barrel second end 24 between a first safety on position and a second safety off position as described in greater detail below.

Barrel Housing

Figure 4:
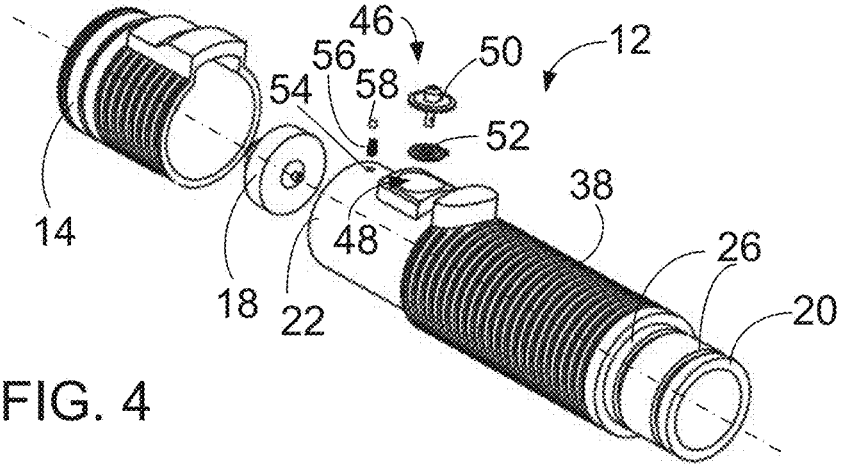
FIG. 4 is a exploded view of an embodiment of a barrel housing for use in the tactical device of FIG. 1.
Figure 5:
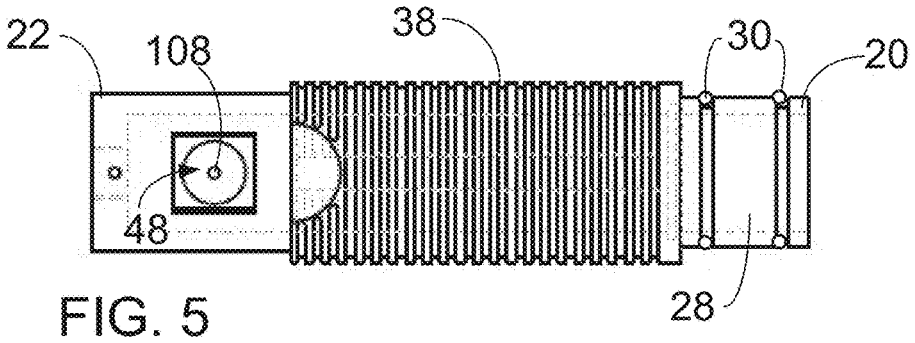
FIG. 5 is a top view of the barrel housing for use in the tactical device of FIG. 4.
Figure 6:
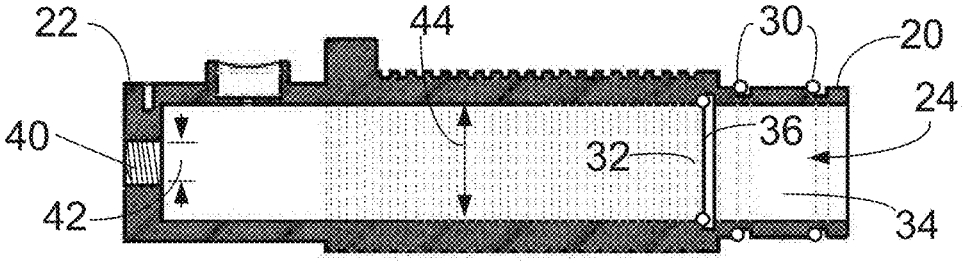
FIG. 6 is a cross section view of the barrel housing of FIG. 5.

Referring to FIGS. 4-6, the barrel housing 12, in various embodiments, is generally cylindrical in shape and may be formed from any suitable material such as metal, metal alloys, polymers, ceramics, etc. The barrel housing 12 defines a circular through hole 24 that extends between and opens through the barrel housing first end 20 and the barrel housing second end 22. In other suitable embodiments, the outer cross-section of the barrel housing 12 may be formed in any suitable shape such as square, polygonal, round, oval, etc. so long as the through hole 24 is substantially circular (e.g., circular) in cross-section. In various embodiments, one or more recesses 26 (FIG. 4) may be formed in an outer surface 28 of the barrel housing first end 20 that are configured to receive a respective O-ring 300 (FIGS. 5-6) so that the O-rings 30 provide a frictional fit between the first end of the barrel housing 20 and an auxiliary device as explained in greater detail below. In addition to the one or more recesses 26, one or more recesses 32 may be formed in an inner circumferential surface 34 that defines the through hole 24 in the barrel housing 12. The one or more recesses 32 are configured to receive a respective O-ring 36 therein to form a frictional fit between the inner circumferential surface of the barrel housing 12 and the barrel 16.

In various embodiments, an outer surface 38 of the barrel housing 12 may be knurled or fitted with a polymer or rubber coating to allow a user to securely grip the barrel housing 12 and to prevent the barrel housing from slipping within the user's grip. In various embodiments, a threading 40 is formed on an inner surface 36 of the barrel housing second end 22 and is configured to releasably couple the firing pin 18 to the second end 22 of the barrel housing as described in more detail below. In various embodiments, a diameter 42 of the inner surface 40 of the barrel housing second end 22 may be smaller than a diameter 44 of the through hole 24 along the length of the barrel housing 12 up to an including the barrel housing first end 20. Said another way, the barrel housing first end 20 has a diameter 44 that is substantially the same as an outer diameter 75 (FIG. 8) of the barrel 16 so that the barrel can be inserted into the barrel housing as explained below.

Referring once again to FIG. 4, in various embodiments, the barrel housing contains a safety mechanism 46 that comprises a recess 48 formed in the barrel housing wall 38, a safety pin 50 and a safety spring 52 that is positioned intermediate the safety pin 50 and the recess 48. Additionally, the outer surface 38 of the barrel housing 12 contains a blind bore 54 that is configured to receive a spring 56 and a detent 58 such as a ball dent, a pin detent, or any other suitable detent. The detent 58 is configured to interact with the safety cap 14 as described in more detail below.

Safety Cap

Figure 6A:
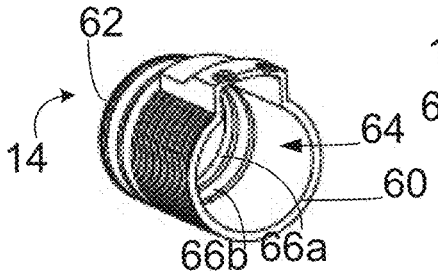
FIGS. 6A-6*b* are perspective views of a barrel housing cap for use with the barrel housing of FIG. 4.
Figure 6B:
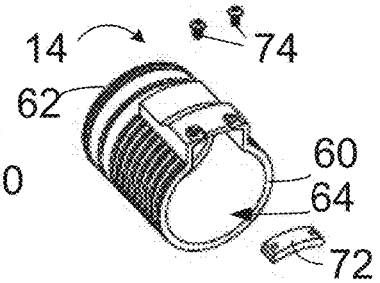
Figure 6C:
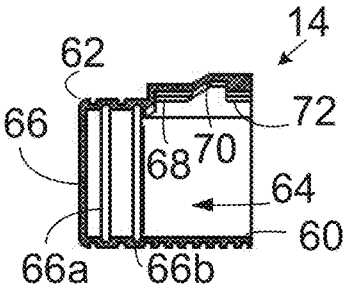
FIG. 6C is a cross section view of the barrel housing cap of FIGS. 6A-6B.

Referring to FIGS. 6A-6C, the safety cap 14 is generally cylindrical in shape and may be formed from any suitable material such as metal, metal alloy, polymers, ceramics or a combination thereof. The safety cap 14 has a first end 60 and a second end 62. The first end 60 opens to a through hole 64 and the second end 62 has an end wall 66. The safety cap 14 contains one or more recesses 66*a* and 66*b* that are configured to engage with the detent 58. The safety cap 14 also contains a stepped safety pin 50 engaging area that comprises a first flat surface 68 and a second flat surface 70 that is offset in the radial direction from the first flat surface 68. A stop 72 is mounted adjacent the second flat surface 70 intermediate the second flat surface 70 and the safety cap first end 60. The stop 72 consists of an arcuate rectangular shaped plate that is retained in place by one or more fasteners 74 (e.g., a rivet, a screw, a stake, etc.).

In various embodiments, the safety cap is about 1.250 inches long with an outside diameter of about 1.000 inches and in inner surface wall diameter of about 0.940 inches. However, it should be understood by one of ordinary skill in the art that the dimensions will change in accordance with the caliber cartridge used in the tactical device. In particular embodiments, the first flat surface 68 is radially offset from the second flat surface 70 by about 0.075 inches so that the first flat surface depresses the safety pin 50 a sufficient distance to block movement of the barrel, as described below.

Barrel

Figure 7:
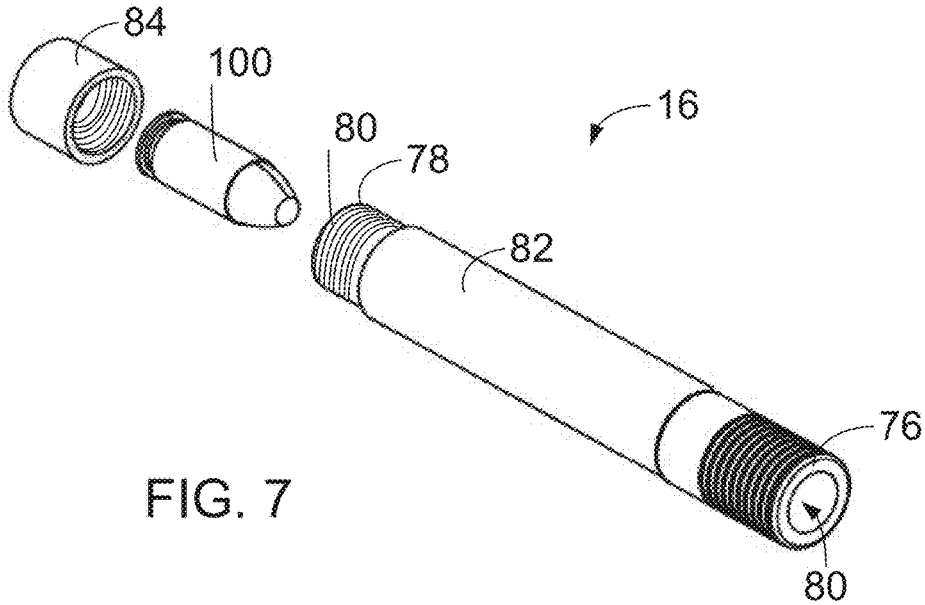
FIG. 7 is an exploded view of an embodiment of a barrel for use in the tactical device of FIG. 1.
Figure 8:
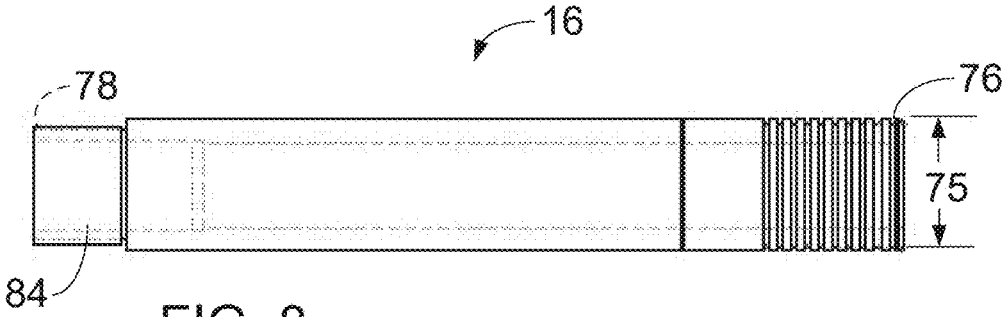
FIG. 8 is side view of the barrel of FIG. 7.

Referring to FIGS. 7-8, the barrel 16 has a first end 76 and a second end 78. In various embodiments, the barrel may be formed from any suitable material such as metal, metal alloys, polymers, ceramics or any suitable combination thereof. The barrel 16 is generally cylindrical in shape and contains a through hole 80 formed from the barrel first end 76 to the barrel second end 78. The through hole 80 has a diameter that is sized to fit a cartridge of a particular caliber. For example, in various embodiments, the diameter of the barrel through-hole 80 for a .45 caliber cartridge is 0.445 inches. In other embodiments, the barrel may be sized to allow for a 9 mm caliber cartridge, a .38 caliber cartridge, a .40 caliber cartridge, etc. where the barrel through hole diameter is appropriately sized for the particular caliber. In various embodiments, the barrel length may be approximately 4.5 inches. In particular embodiments, the barrel length is 4.675 inches. In other embodiments, the barrel length may be two inches. In still other embodiments, the barrel length may be twenty-four inches. It should be understood that the barrel length may be any suitable length depending on the application of the tactical device.

In various embodiments and referring again to FIG. 6, the one or more recesses 32 (e.g., grooves) formed in the barrel housing 12 are configured to receive a respective O-ring 36 in the one or more grooves formed in the barrel housing inner surface 34. In this way, the integrity of the barrel is maintained by not reducing the wall thickness to form one or more grooves for retaining the O-rings on the barrel. However, it should be understood that in certain embodiments, one or more grooves may be formed in the outer surface of the barrel so that the O-rings are received in the one or more groves formed on the outer surface of the barrel. In either case, the O-rings provide a snug fit between the barrel 16 and the barrel housing 12 so that the barrel does not slide with respect to the barrel housing without placing a sufficient force against the first end of the barrel 76 to overcome the frictional force between the barrel and the O-ring. Referring once more to FIG. 7, the barrel second end 78 also contains a thread 80 formed on the outer surface 82 of the barrel. The thread 80 is configured to threadably receive an end cap 84 (FIGS. 7 and 9A-9C) as discussed below.

End Cap

Figure 9A:
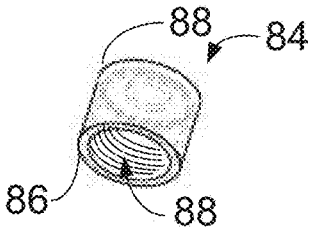
FIGS. 9A-9C are views of a cartridge retention cap for use with the barrel of FIG. 7.
Figure 9B:
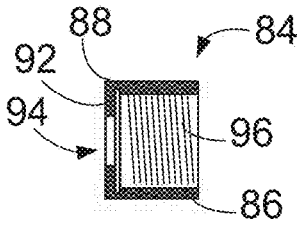
Figure 9C:
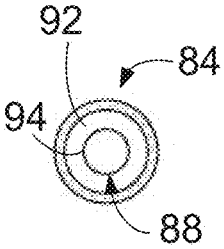

Referring to FIGS. 9A-9C, the end cap 84 is generally cylindrical in shape and may be formed from any suitable material such as metal, metal alloy, polymers, ceramics or a combination thereof. The end cap 84 has a first end 86 and a second end 88. The first end 86 opens to a through hole 90. The second end 88 also opens to the through hole 90 but has an end wall 92 that defines an opening 94 there through. The end cap 84 has a thread 96 formed on an inner surface that is configured to releasably engage with the barrel second end thread 80. The end cap is configured to retain a cartridge 100 that is inserted into the barrel second end 78 (FIG. 7). That is, when the user inserts a cartridge 100 into the barrel second end 78, the user then screws the end cap 84 onto the barrel second end 78 so that the rear end of the cartridge aligns with the opening 94 formed in the end cap second end wall 92. In this way, the firing pin 18 (FIG. 3) can contact the end of the cartridge 100 through the end cap 84 as described in more detail below.

In various embodiments, the end cap is 0.550 inches long with an outside diameter of 0.695 inches. However, it should be understood by one of ordinary skill in the art that the dimensions will change in accordance with the caliber cartridge used in the tactical device.

Safety Pin

Figure 10A:
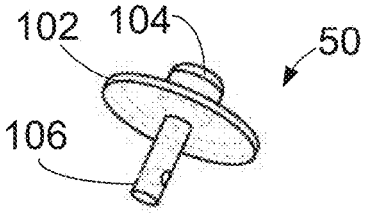
FIGS. 10A-10C are views of an embodiment of a safety mechanism for use in the tactical device of FIG. 1.
Figure 10B:
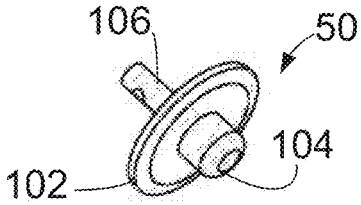
Figure 10C:
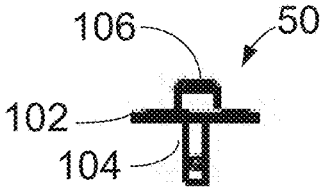

Referring to FIGS. 10A-10C, the safety pin 50 is formed from a cylindrical disc 102, a first upward extending stud 104 and a second downward extending stud 106. The cylindrical disc 102, first upward extending stud 104 and second downward extending stud 106 may be formed from three separate pieces that are coupled together by welding, a fastener (e.g. a screw, rivet etc.), press fitting, etc. or they may be formed from one integral piece of material. The safety pin 50 may be formed from any suitable material such as metal, metal alloy, ceramic, polymer, or combination thereof based on the application for the tactical device. In preferred embodiments, the safety pin 50 is made from a metal or metal alloy. Referring once more to FIGS. 4-5, the safety pin 50 is configured to be received in the recess 48 such that the second downward extending stud 106 is received through an opening 108 located at the bottom of the recess 48, which opens into the through hole 24. In this way, the second downward extending stud 106 extends into the through hole 24 of the barrel housing 12.

The safety pin 50 is spring loaded in the recess 48 by the spring 52, which is positioned around the second downward extending stud 106. In this configuration, the first upward extending stud 104 is biased radially outward from the barrel housing so that the first upward extending stud 104 engages with the first flat surface 68 and a second flat surface 70 of the safety cap 14 (FIGS. 6A-6B).

Firing Pin

Figure 11A:
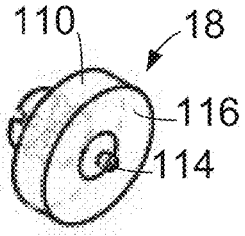
FIGS. 11A-11C are views of an embodiment of a firing pin for use in the tactical device of FIG. 1.
Figure 11B:
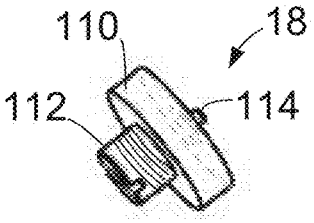
Figure 11C:
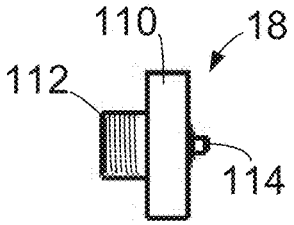

Referring to FIGS. 11A-11C, the firing pin 18 is formed from a cylindrical puck 110 and a threaded stud 112. The cylindrical puck 110 and threaded stud 112 may be formed from two separate pieces that are coupled together by welding, a fastener (e.g. a screw, rivet etc.), press fitting, etc. or they may be formed from one integral piece of material. The firing pin 18 may be formed from any suitable material such as metal, metal alloy, ceramic, polymer, or combination thereof based on the application for the tactical device. In preferred embodiments, the firing pin 18 is made from a metal or metal alloy. The firing pin 18 further comprises a protrusion 114 that is formed on a first end 116 of the firing pin 18. The protrusion 114 is sized and shaped to engage with the end of the cartridge to strike the primer in the cartridge.

In various embodiments for a .45 caliber cartridge, the puck is 0.70 inches in diameter and 0.188 inches in length. The threaded stud is 0.220 inches long and the overall length of the firing pin 18 from the tip of the protrusion 114 to the end of the threaded stud 112 is 0.500 inches. The threaded stud 112, in various embodiments, contains a 5/16-24 thread. However, it should be understood by those skilled in the art that the overall dimensions will vary depending on the caliber cartridge used in the tactical device. The threaded stud 18 is configured to be received in a threaded hole 40 (FIG. 6) formed in the barrel housing 12 as explained in more detail herein.

Operation of the Tactical Device

Figure 12A:
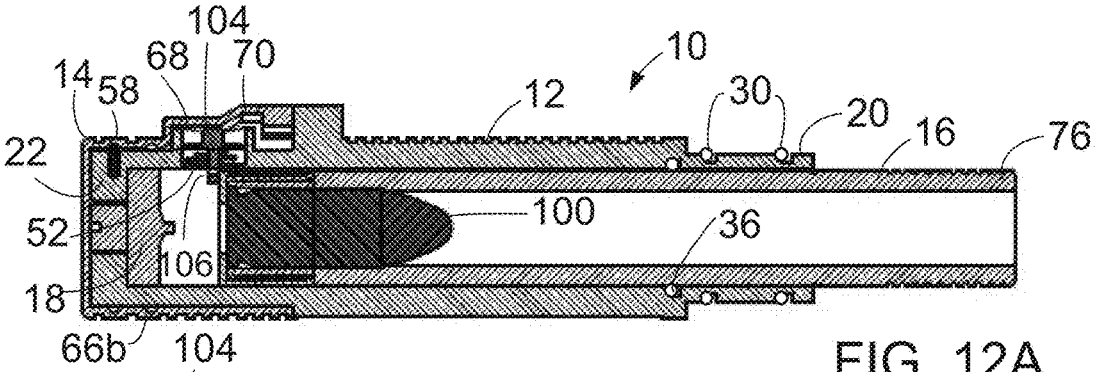
FIGS. 12A-12B are cross section views of the tactical device of FIG. 1 where the safety is in a safety on position and a safety off position.
Figure 12B:
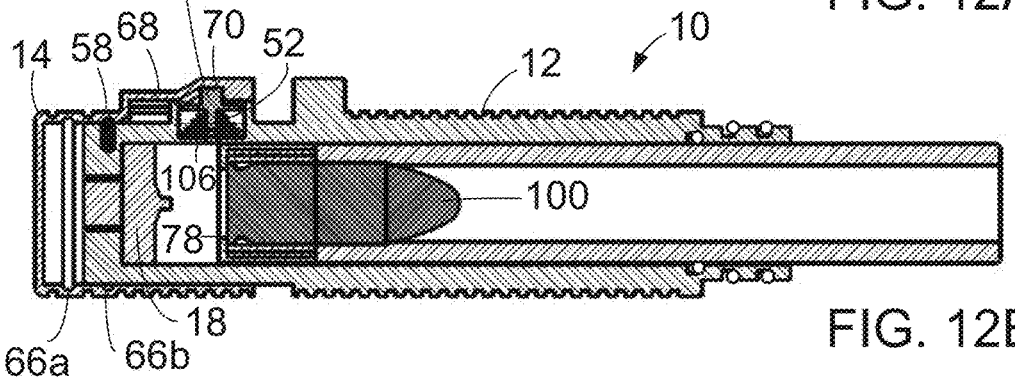

Referring to FIGS. 12A-12B, the tactical device 10 is assembled by first inserting a cartridge 102 (e.g., a .45 caliber cartridge) into the barrel second end 78 so that a rear end of the cartridge 100 abuts the second end 78 of the barrel 16. The user than places the end cap 84 over the barrel second end 78 and threadably attaches the end cap 84 to the barrel second end 78 so that the opening 94 in the end cap second end wall 92 aligns with the rear end of the cartridge (See also FIGS. 7-9C).

The firing pin 18 is threadably attached to the threaded opening 40 formed in the barrel housing second end 22 so that the firing pin protrusion 114 faces the barrel housing first end 20 (See also FIG. 6). This completed by dropping the firing pin 18 into the barrel housing through hole 24 through the barrel housing first end 20 so that the firing pin threaded stud 112 aligns with the threaded opening 40 in the barrel housing second end 22. The threaded engagement between the threaded stud 112 and the threaded opening 40 axially fixes the firing pin 18 with respect to the barrel housing 12. In various embodiments, the firing pin may be maintained in place using a set screw to prevent the firing pin from rotating once mounted in place.

Next the user inserts the barrel second end 78 (FIG. 7) into the barrel housing first end 20. The barrel 16 can move axially with respect to the barrel housing 12 but is snuggly fit within the barrel housing 12 by interaction of the one or more O-rings 36 that are received in the respective groove 32 formed in the inner surface of the barrel housing proximate the barrel housing first end 20. In this way, the barrel 16 can be moved in a controlled manner once the barrel second end 78 is inserted into the barrel housing first end 20.

Lastly, the user can move the safety cap 14 into a first safety on position (FIG. 12A) by sliding the safety cap 14 axially toward the barrel housing second end 22 so that the detent 58 is received in the first recess 66*a* formed in the inner surface wall of the safety cap. When in this position, the first flat surface 68 of the safety cap 14 engages with the first upward extending stud 104 of the safety pin causing the safety pin to move radially inward with respect to the barrel housing 12. Said another way, the safety pin 50 (FIGS. 10A-10B) is pushed radially inward against the radially outward bias of the spring 52 thereby causing the second downward extending stud 106 to move into the through hole 24 (FIG. 6) of the barrel housing 12 as shown specifically in FIG. 12A. When in this position, the second downward extending stud 106 blocks axial movement of the barrel second end 78 toward the firing pin 18. Thus, the tactical device cannot be fired when the safety pin is being pushed radially inward with respect to the barrel housing 12.

Once the user is ready to fire the tactical device, the user can move the safety cap from the safety on position shown in FIG. 12A into the ready to fire position shown in FIG. 12B by sliding the safety cap 14 rearward with respect to the barrel housing second end 22 so that the detent 58 moves from the recess 66*a* into the recess 66*b*. As the safety cap is slid backward with respect to the barrel housing, the first upward extending stud 104 of the safety pin moves from the first flat surface 68 of the safety cap 14 to the second flat surface 70, which is positioned radially outward from the first flat surface. As the first upward extending stud 104 is allowed to move radially outward, the safety pin is biased radially outward from the barrel housing recess 48 by the spring 52 so that the second downward extending stud 106 moves out of the barrel housing through hole 24.

Once the tactical device is in the safety off position shown in FIG. 12B, the barrel second end 78 is spaced apart from the firing pin protrusion 114 and the barrel 16 can be moved axially toward the barrel housing second end 22 since the safety pin 46 is no longer in the barrel housing through hole 24. When the user is ready to fire the tactical device 10, the user grasps the barrel housing 12 tightly in their hand and depresses the barrel first end 20 against an object. As the barrel first end 20 is pressed against the object, the barrel 16 moves axially with respect to the barrel housing 12 against the frictional forces generated by the O-rings 36 against the barrel outer surface 82 until the end cap 84 moves into contact with the firing pin puck 110. In this second position, the protrusion 114 strikes the rear end of the cartridge 100 causing the primer to ignite the propellant in the cartridge 100. When this happens, the projectile is forced out the barrel first end 76 into the object. Once the cartridge is fired, the user can reload the tactical device 10 in the same way that the device was originally loaded.

Accessory Device

Figure 13A:
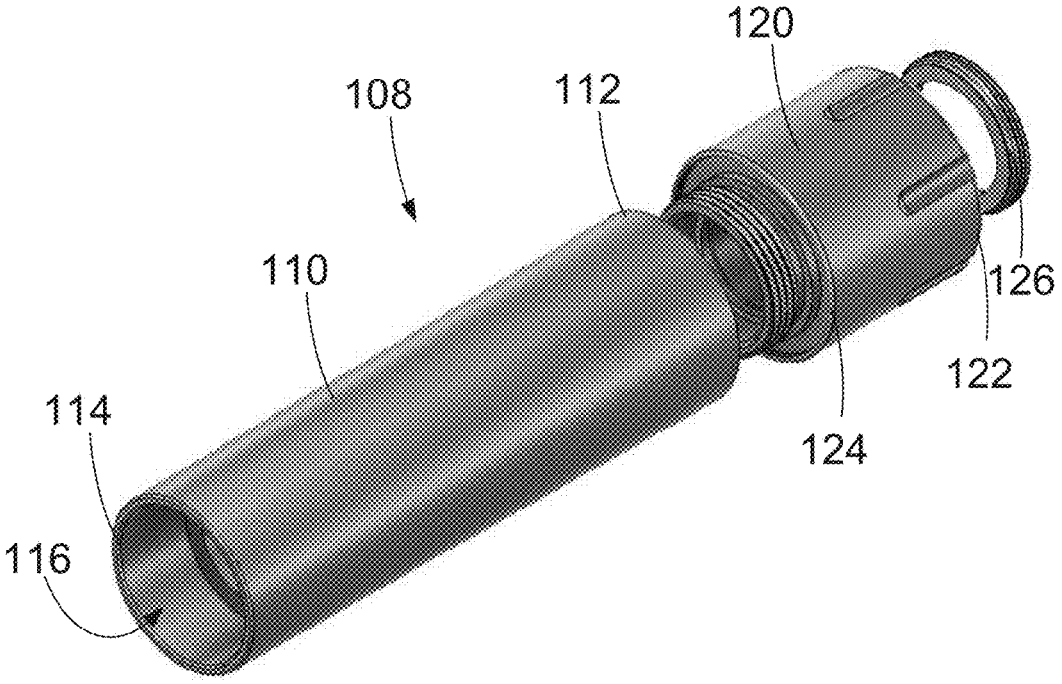
FIGS. 13A-13B are perspective views of a flashlight device for use with the tactical device of FIG. 1.
Figure 13B:
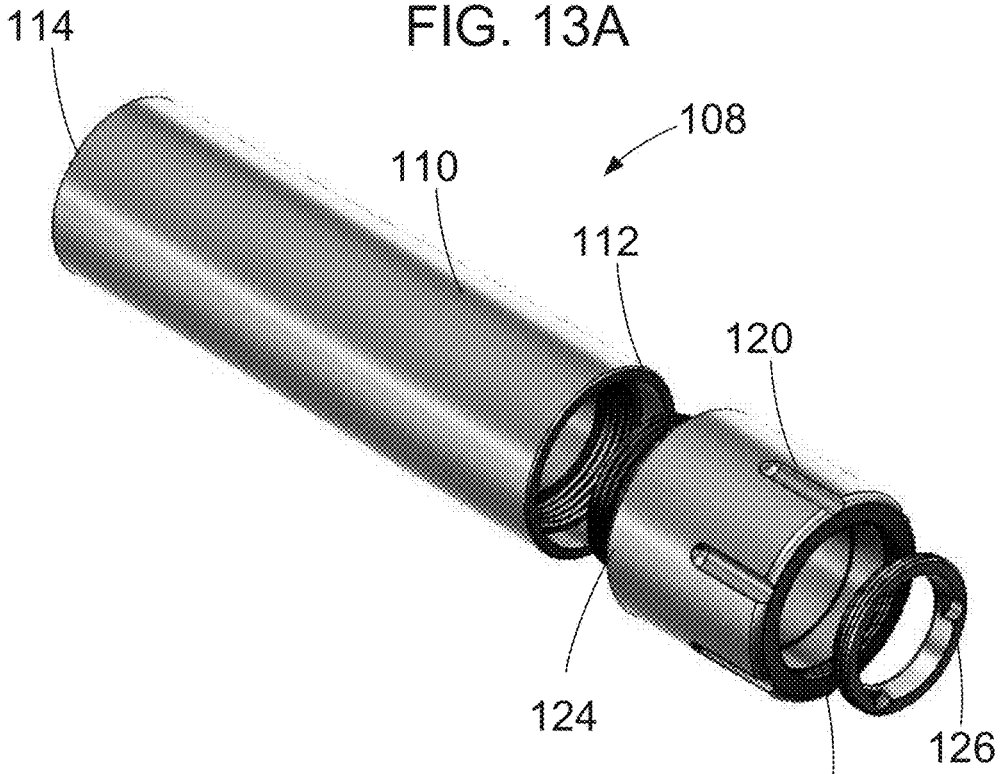

In various embodiments and referring to FIGS. 13A-13B, an accessory 108 may be configured to attach over the barrel first end 76 to the barrel housing first end 20. For example, the accessory 108 may be formed from a generally cylindrical first body portion 110 that comprises a first end 112, a second end 114 and a through hole 116 formed between the first and second ends. The through hole 116 at the second end 114 is sized and shaped to removeably receive the barrel housing first end 20 so that the O-rings 30 (FIG. 5) provide a frictional fit between the barrel housing first end 20 and the inner circumferential wall that defines the through hole 116.

A second body portion 120 of the accessory 108 may take the form of any number of accessories such as a flashlight, a knife blade, an umbrella, a cane, etc. For purposes of discussion, the accessory shown in the figures is that of a flashlight having a generally cylindrically shaped body with a first end 122, a second end 124 and a lens 126. In particular embodiments, the second body portion second end 124 is configured to releasably attach to the first body portion first end 112 by any suitable fastener such as threads. The second body portion 120 is configured to house a power source such as a batter, a bulb, a reflector, etc. Thus, when the accessory is coupled to the barrel housing, the user may operate the tactical device as a flashlight. In case of emergency where the user feels threatened by another person, the user can remove the accessory 108 from the barrel housing so that the tactical device 10 can be used against an attacker by depressing the barrel first end 76 against the attacker.

It should also be understood that the tactical device 10 may be built into many other devices such as a cane, a walking stick, an umbrella, a knife etc. For example, in the case of an umbrella, the handle may be configured to act as the accessory 108 so that when the tactical device 10 is removed from the umbrella, the user can jab an object with the exposed barrel first end 76 causing the cartridge to fire.

Second Embodiment of a Tactical Device

Figure 14:
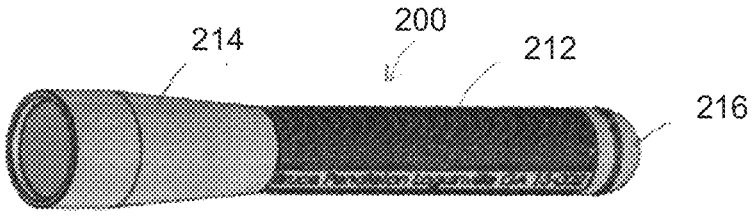
FIG. 14 is a perspective view of a tactical device in accordance with one embodiment of the present invention.
Figure 15A:
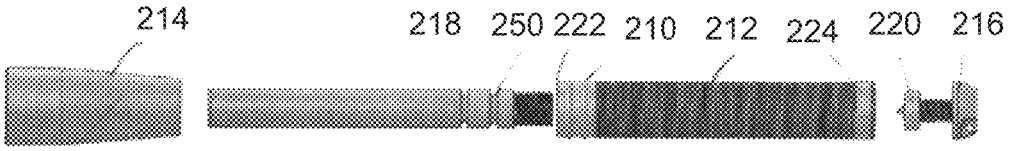
FIGS. 15A and 15B are an exploded view of the tactical device of FIG. 14.
Figure 15B:
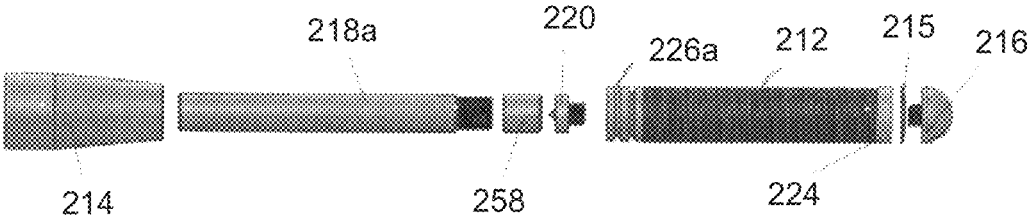

Referring particularly to FIGS. 14 and 15A-15B, a tactical device 210 generally comprises a barrel housing 212, a safety cap 214 and an end cap 216. The tactical device 210 further comprises a barrel 218 and a firing pin 220. The barrel 218 is received in a first end 222 of the barrel housing 218 and the firing pin 220 is received in a second end 224 of the barrel housing and axially fixed therein. Furthermore, the end cap 216 is configured to be at least partially received by the barrel housing second end 224 to seal off the barrel housing second end 224. The safety cap 214 is configured to be releasably received over the barrel first end 222 and retained thereon by one or more O-rings 226 that engage with an inner surface of the safety cap 214.

Barrel Housing

Figure 16B:
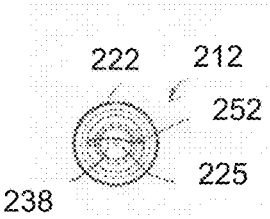
FIGS. 16A-16C are a barrel housing for use in the tactical device of FIG. 14.
Figure 16A:
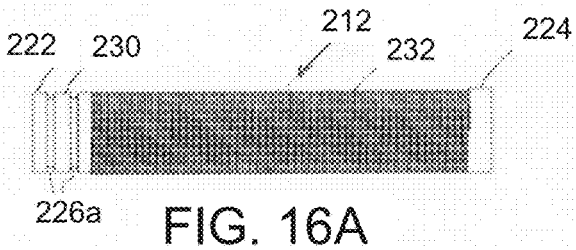
Figure 16C:
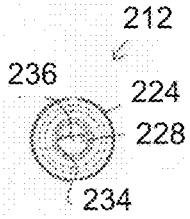

Referring to FIGS. 16A-16C, the barrel housing 212, in various embodiments, is generally cylindrical in shape and may be formed from any suitable material such as metal, metal alloys, polymers, ceramics, etc. The barrel housing 212 defines a circular through hole 228 that extends between and opens through the barrel housing first end 222 and the barrel housing second end 224. In other suitable embodiments, the outer cross-section of the barrel housing 212 may be formed in any suitable shape such as square, polygonal, round, oval, etc. so long as the through hole 28 is substantially circular (e.g., circular) in cross-section. In various embodiments, one or more recesses 226*a* may be formed in the outer surface 230 of the barrel housing first end 222 that are configured to receive a respective O-ring 226 (FIG. 14A-14B) so that the safety cap 214 (FIG. 14A-14B) can be retained on the barrel housing first end 222 by a frictional fitting between the O-rings 226 and the safety cap 214 as explained below.

In various embodiments, the outer surface 232 of the barrel housing 212 may be knurled or fitted with a polymer or rubber coating to allow a user to securely grip the barrel housing 212 and to prevent the barrel housing from slipping within the user's grip. In various embodiments, a threading 234 is formed on an inner surface 236 of the barrel housing second end 224. In various embodiments, a diameter 236 of the inner surface 234 of the barrel housing second end 224 may be smaller than a diameter 238 of the through hole 228 along the length of the barrel housing 212 up to an including the barrel housing first end 222. Said another way, the barrel housing first end 222 has a diameter 238 that is substantially the same as an outer diameter 240 (FIG. 17A) of the barrel 218 so that the barrel can be inserted into the barrel housing as explained below.

Barrel

Figure 17B:
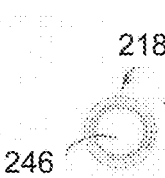
FIGS. 17A-17C are a barrel for use in the tactical device of FIG. 14.
Figure 17A:
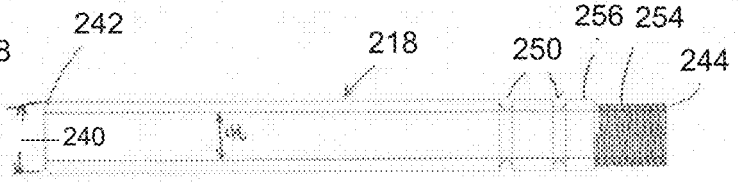
Figure 17C:
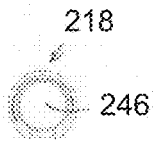

Referring to FIGS. 17A-17C, the barrel 218 has a first end 242 and a second end 244. In various embodiments, the barrel may be formed from any suitable material such as metal, metal alloys, polymers, ceramics or any suitable combination thereof. The barrel 218 is generally cylindrical in shape and contains a through hole 46 formed from the barrel first end 242 to the barrel second end 244. The through hole 246 has a diameter 248 that is sized to fit a cartridge of a particular caliber. For example, in various embodiments, the barrel through-hole diameter 248 for a .32 caliber cartridge is 0.338 inches. In other embodiments, the barrel may be sized to allow for a 9 mm caliber cartridge, a .38 caliber cartridge, a .40 caliber cartridge, etc. In various embodiments, the barrel length may be 4.5 inches. In other embodiments, the barrel length may be two inches. In still other embodiments, the barrel length may be twenty-four inches. It should be understood that the barrel length may be any suitable length depending on the application of the tactical device.

Figure 22:
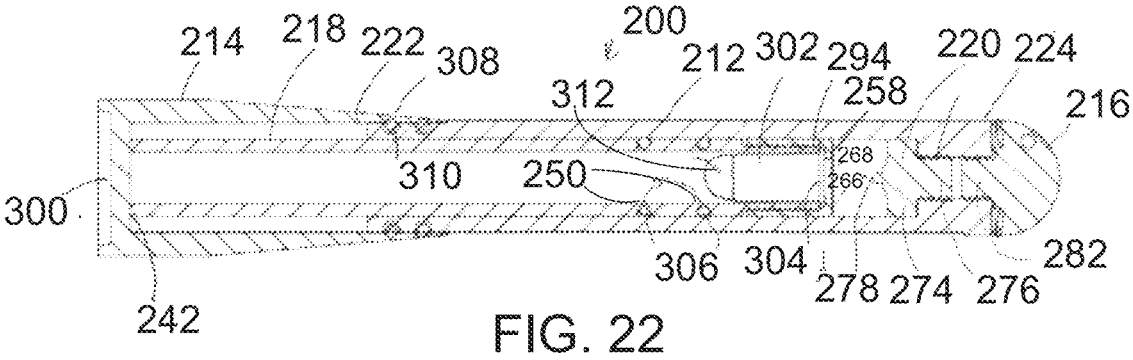
FIG. 22 is a sectional view of the tactical device of FIG. 14.

Referring particularly to FIG. 17A, the barrel 218 has one or more recesses 250 formed therein proximate the barrel second end 244 that are configured to receive a respective O-ring (FIG. 22). The O-rings are configured to provide a frictional fit between the barrel and an inner surface 252 (FIG. 16B) of the barrel housing 212. In various embodiments and referring to FIG. 15B, the one or more recesses 250 may, instead, be formed in the barrel housing 212 so that groves (not shown) are defined in the inner surface 252 so that the O-rings are received in the one or more grooves formed in the barrel housing inner surface 252 instead of in grooves 250 formed in the barrel 218. In this way, the integrity of the barrel is maintained by not reducing the wall thickness to form the grooves for retaining in the O-rings. Referring once more to FIG. 15A, in addition to the one or more grooves 250, the barrel second end 244 also contains a thread 254 formed on the outer surface 256. The thread 254 is configured to threadably receive an end cap 258 (FIG. 18A-18C) ad discussed below.

End Cap

Figure 18B:
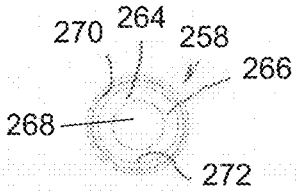
FIGS. 18A-18C are a cartridge retention cap for use in the tactical device of FIG. 14.
Figure 18A:
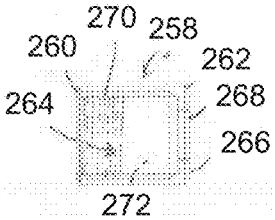
Figure 18C:
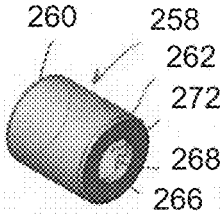

Referring to FIGS. 18A-18C, the end cap 258 is generally cylindrical in shape and may be formed from any suitable material such as metal, metal alloy, polymers, ceramics or a combination thereof. The end cap 258 has a first end 260 and a second end 262. The first end 260 opens to a through hole 264. The second end 262 also opens to the through hole 264 but has an end wall 266 that defines an opening 268 there through. The end cap 258 has a thread 270 formed on an inner surface 272 that is configured to releasably engage with the barrel second end thread 254. The end cap is configured to retain a cartridge that is inserted into the barrel second end 244 (FIG. 17A). That is, when the user inserts a cartridge into the barrel second end 244, the user then screws the end cap 258 onto the barrel second end 244 so that the rear end of the cartridge aligns with the opening 268 formed in the end cap second end wall 266. In this way, the firing pin can contact the end of the cartridge through the end cap 258 as described in more detail below.

In various embodiments, the end cap is 0.550 inches long with an outside diameter of 0.495 inches and in inner surface wall 272 and thread 270 formed by a 7/16-20 drill and tap. However, it should be understood by one of ordinary skill in the art that the dimensions will change in accordance with the caliber cartridge used in the tactical device.

Firing Pin

Figure 19B:
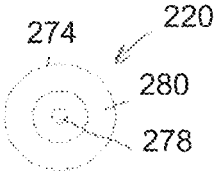
FIGS. 19A-19C are a firing pin for use in the tactical device of FIG. 14.
Figure 19A:
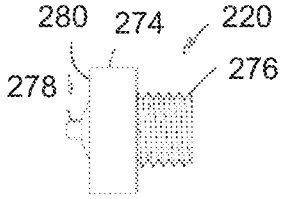
Figure 19C:
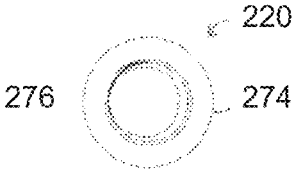

Referring to FIGS. 19A-19C, the firing pin 220 is formed from a cylindrical puck 274 and a threaded stud 276. The cylindrical puck 274 and threaded stud 276 may be formed from two separate pieces that are coupled together by welding, a fastener (e.g. a screw, rivet etc.), press fitting, etc. or they may be formed from one integral piece of material. The firing pin 220 may be formed from any suitable material such as metal, metal alloy, ceramic, polymer, or combination thereof based on the application for the tactical device. In preferred embodiments, the firing pin 220 is made from a metal or metal alloy. The firing pin 220 further comprises a protrusion 278 that is formed on a first end 280 of the firing pin 220. The protrusion 278 is sized and shaped to engage with the end of the cartridge to strike the primer in the cartridge.

In various embodiments for a .32 caliber cartridge, the puck is 0.50 inches in diameter and 0.188 inches in length. The threaded stud is 0.220 inches long and the overall length of the firing pin 220 from the tip of the protrusion 278 to the end of the threaded stud 276 is 0.500 inches. The threaded stud 276, in various embodiments, contains a 5/16-24 thread. However, it should be understood by those skilled in the art that the overall dimensions will vary depending on the caliber cartridge used in the tactical device. The threaded stud 276 is configured to be received in a threaded hole formed in the barrel housing 212 as explained in more detail herein.

Housing Cap

Figure 20B:
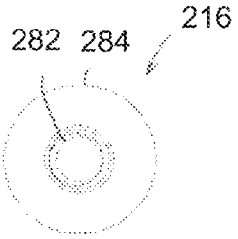
FIGS. 20A-20C are an end cap for use in the tactical device of FIG. 14.
Figure 20A:
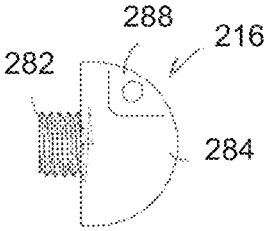
Figure 20C:
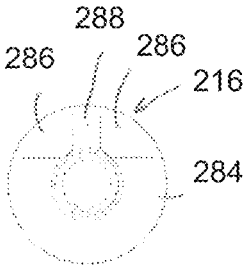

Referring to FIGS. 20A-20C, the housing cap 216 has a threaded stud 282 and a body 284. The body 284 contains one or more recessed areas 286 that defines a wall 288 that connect to a strap, a handle, a ring or any other suitable fastener. The housing cap 216 may be formed from any suitable material such as metal, metal alloy, ceramic, polymers or some combination thereof. In various embodiments, the housing cap 216 is formed from a metal or metal alloy. The threaded stud 282 is configured to be threadably engaged with a threaded bore (FIG. 22) formed in the barrel housing 212 as described below. In various embodiments, the threaded stud 282 is 0.188 inches long and has a 5/16-24 threaded formed thereon. In various embodiments, the overall length of the housing cap 216 from the end of the threaded stud 282 to the end of the body 284 is 0.625 inches in length, and the body 284 has an outside diameter of 0.735 inches. However, one of ordinary skill in the art should understand that these dimensions may vary depending on the application of the tactical device 10 and the caliber cartridge being used.

Safety Cap

Figure 21B:
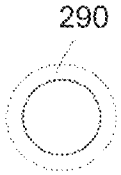
FIGS. 21A-21C are a safety cap for use in the tactical device of FIG. 14.
Figure 21A:
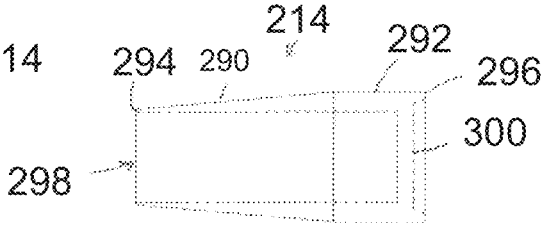
Figure 21C:
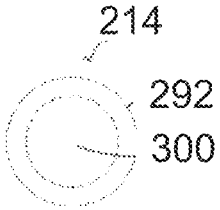

Referring to FIGS. 21A-21C, the safety cap 214 is generally formed from a first frusto-conical portion 290 and a second cylindrical portion 292. In various embodiments, the first frusto-conical portion 290 and the second cylindrical portion 292 are integrally formed from a single piece of material. In other embodiments, the two portions are formed separately and are coupled together. In various embodiments, the safety cap 214 may be formed from metal, metal alloy, ceramic, polymers of a combination thereof. A first end 294 of the safety cap 214 may open to a blind bore 298 formed through the first end. The blind bore 298 may be sized and shaped so that the safety cap fits on and over the barrel housing first end 222 (FIG. 15). The second end 296 of the safety cap has a wall 300. In various embodiments, the safety cap 214 is 2.2 inches in length and the blind bore 298 has a diameter of 0.717 inches for a tactical device 210 that uses a .32 caliber cartridge. The cylindrical second portion 292 has an outer diameter of 1.00 inches and a length of 0.686 inches. However, it should be understood that the length of each portion and the overall length of the safety cap 214 can vary depending on the application.

Operation of the Tactical Device

Referring to FIG. 22, the tactical device 210 is assembled by first inserting a cartridge 302 (e.g., a .32 caliber cartridge) into the barrel second end 244 so that a rear end 304 of the cartridge 302 abuts the second end 244 of the barrel 218. The user than places the end cap 258 over the barrel second end 244 and threadably attaches the end cap 258 to the barrel second end 244 so that the opening 268 in the end cap second end wall 266 aligns with the rear end of the cartridge.

The firing pin 220 is threadably attached to the threaded opening 228 formed in the barrel housing second end 224 so that the firing pin protrusion faces the barrel housing first end 222. The threaded engagement between the threaded stud 276 and the threaded opening 228 axially fixes the firing pin 220 with respect to the barrel housing 212. Moreover, the housing cap 216 is threadably attached to the barrel housing second end 224 via engagement of the housing cap threaded stud 282 and the threaded opening 228 formed in the barrel housing second end 224.

Next the user inserts the barrel second end 244 into the barrel housing first end 222. The barrel 218 can move axially with respect to the barrel housing 212 but is snuggly fit within the barrel housing 212 by interaction of one or more O-rings 306 that are received in the respective groove 250 formed in the outer surface of the barrel proximate the barrel second end 244. In this way, the barrel can be moved in a controlled manner once the barrel second end 244 is inserted into the barrel housing first end 222. Lastly, the user can move the barrel 218 into a first ready to fire position (as shown in FIG. 22) by placing the safety cap 214 onto the barrel housing first end 222 so that the barrel first end 242 abuts the safety cap end wall 300. As the user presses the safety cap 214 onto the barrel housing 218, the end wall forces the barrel 218 to move with respect to the barrel housing 212 until recesses 308 formed in an inner wall of the safety cap first frusto-conical portion 290 receive O-rings 310 that are retained in recesses 226.

When the tactical device is in the first ready to fire position shown in FIG. 22, the barrel second end 244 is spaced apart from the firing pin protrusion 278. While the safety cap 214 is retained on the barrel housing first end 222, the firing pin 220 will not inadvertently contact the cartridge end 304. When the user is ready to fire the tactical device 210, the user removes the safety cap 214 from the barrel housing 212, grasps the barrel housing tightly in their hand and depresses the barrel first end 242 against an object. As the barrel first end is pressed against the object, the barrel 218 moves axially with respect to the barrel housing 212 against the frictional forces generated by the O-rings 306 against the barrel housing inner surface until the end cap 258 moves into contact with the firing pin puck 274. In this second position, the protrusion 278 strikes the rear end 304 of the cartridge 302 causing the primer to ignite the propellant in the cartridge 302. When this happens, the projectile 312 is forced out the barrel first end 242 into the object. Once the cartridge is fired, the user can reload the tactical device 210 in the same way that the device was originally loaded.

In various embodiments, the safety cap 214 may contain a flashlight device in the second cylindrical portion 292 to provide additional functionality to the user. That is, when the safety cap is on the barrel housing, the user may operate the tactical device (which is in the first ready to fire position) as a flashlight. In case of emergency where the user feels threatened by another person, the user can remove the flashlight safety cap 214 from the barrel housing so that the tactical device 210 can be used against an attacker by depressing the barrel first end 242 against the attacker. It should also be understood that the tactical device 210 may be built into many other devices such as a cane, a walking stick, an umbrella, etc. For example, in the case of an umbrella, the handle may be configured to act as the safety cap so that when the umbrella handle is removed from the umbrella, the user can jab an object with the exposed barrel first end 222 causing the cartridge to fire.

CONCLUSION

Many modifications and other embodiments of the invention will come to mind to one skilled in the art to which this invention pertains, having the benefit of the teaching presented in the foregoing descriptions and the associated drawings. Therefore, it is to be understood that the invention is not to be limited to the specific embodiments disclosed and that modifications and other embodiments are intended to be included. Although specific terms are employed herein, they are used in a generic and descriptive sense only and not for the purposes of limitation.

What is claimed is:

1. A tactical device comprising:

a. a barrel comprising, a first end, a second end having an opening formed therein, a first through hole that extends from the first end to the second end, a first outer diameter, and a first inner diameter that defines the through hole;

b. a barrel housing comprising a first end, a second end, and a second through hole that extends from the first end to the second end, wherein the second through hole has a second inner diameter that is larger than the first outer diameter of the barrel, wherein the barrel second end is configured to be inserted into the barrel housing first end and the barrel is axially moveable with respect to the barrel housing when the barrel second end is inserted into the barrel housing first end;

c. a firing pin mounted in the second through hole of the barrel housing proximate to the barrel housing second end, the firing pin having a protrusion that extends toward the barrel housing first end;

d. a safety mechanism comprising a safety recess formed in an outer circumferential surface of the barrel housing, an opening at a base of the safety recess that opens into the second through hole, and a safety comprising:

i. a safety disc, ii. a first stud extending from the safety disc, iii. a second stud extending from the safety disc, and iv. a spring; and e. a safety cap moveably coupled to the second end of the barrel housing and moveable between a first safety off position and a second safety on position, wherein the safety cap comprises:

i. a first end defining an opening therein, ii. a second end, iii. an inner circumferential surface that defines a sidewall of a blind bore that extends toward the second end from the opening;

iv. a first flat surface formed in the inner circumferential surface of the safety cap that is formed at a first radial distance from a central axis that extends between the first end and the second end of the safety cap, and v. a second flat surface formed in the inner circumferential surface of the safety cap that is formed at a second radial distance from the central axis that is larger than the first radial distance, wherein:

the safety is received in the safety recess such that the second stud passes through the opening at the base of the safety recess, the spring is positioned intermediate the safety disc and the safety recess such that the spring biases the safety disc radially outward of the safety recess, the barrel is moveable with respect to the barrel housing between:

a first position in which the opening in the second end of the barrel is spaced apart from the protrusion on the firing pin, and a second firing position in which the barrel is moved axially with respect to the barrel housing such that the firing pin protrusion extends through the opening in the second end of the barrel, the safety cap is moveable between:

a safety on first position in which the first flat surface engages with the first stud thereby pushing the safety radially inward such that the second stud is moved into the second through hole in the barrel housing thereby preventing the barrel from moving from the first position into the firing second position, and a second safety off position in which the second flat surface engages with the first stud thereby allowing the spring to bias the safety disc radially outward with respect to the safety recess so that the second stud exits the second through hole thereby allowing the barrel to move into the second firing position.

2. The tactical device of claim 1, further comprising an end cap comprising:

a. a first open end;

b. a second end defining an opening that defines the opening in the second end of the barrel; and c. and a third inner diameter that is substantially equal to the first outer diameter of the barrel;

wherein the end cap is configured to be removeably coupled to the second end of the barrel.

3. The tactical device of claim 2, wherein the barrel second end and end cap are configured to allow a user to insert a cartridge in the barrel second end intermediate the barrel second end and the end cap second end so that the opening in the end cap second end aligns with a firing cap in the cartridge.

4. The tactical device of claim 3, wherein the end cap is removeably attached to the barrel second end by threads.

5. The tactical device of claim 1, wherein one of a barrel housing inner circumferential surface or a barrel outer circumferential surface further comprises one or more annular recesses formed therein that are each configured to receive a respective O-ring therein, wherein the respective O-ring provides a frictional fit between the barrel housing and the barrel such that the barrel moves axially with respect to the barrel housing when a sufficient force is exerted against the barrel.

6. The tactical device of claim 1, further comprising one or more annular recesses formed on an outer circumferential surface of the barrel housing, wherein each one off the one or more annular recesses are configured to receives a respective O-ring therein.

7. The tactical device of claim 4, further comprising an accessory comprising:

a. a first end defining a blind bore therein that has an inner diameter that is substantially equal to an outer diameter of the barrel housing; and b. a second end;

wherein an inner circumferential surface of the blind bore comprises one or more annular recesses formed therein that are each configured to receive a respective one or more of the O-rings, and wherein the accessory covers the first end of the barrel.

8. The tactical device of claim 7, wherein the accessory is selected from a group consisting of:

a. a flashlight;

b. a knife;

c. an umbrella; and d. a cane.

9. A tactical device comprising:

a. a barrel comprising a first end, a second end having an opening formed therein, a first through hole that extends from the first end to the second end, a first outer diameter, and a first inner diameter that defines the first through hole; and b. a barrel housing comprising a first end, a second end, and a second through hole that extends from the first end to the second end, wherein the second through hole has a second inner diameter that is larger than the first outer diameter of the barrel, and the barrel second end is configured to be inserted into the barrel housing first end and move axially with respect to the barrel housing;

c. an end cap comprising a first open end, a second end defining an opening there through, wherein the end cap is configured to be removeably coupled to an exterior surface of the second end of the barrel; and d. a firing pin mounted in the barrel housing second through hole proximate to the barrel housing second end, the firing pin having a protrusion that extends toward the barrel housing first end;

wherein the barrel is moveable with respect to the barrel housing between:

a first position in which the opening in the second end of the barrel is spaced apart from the protrusion on the firing pin, and a second firing position in which the barrel is moved axially with respect to the barrel housing such that the protrusion extends through the opening in the end cap.

10. The tactical device of claim 9, further comprising a safety cap.

11. The tactical device of claim 9, wherein the barrel housing and the barrel are formed from a material selected from a group consisting of a metal, a metal alloy and a ceramic.

12. The tactical device of claim 9, wherein an outer circumferential surface of the barrel housing is at least partially covered by a rubber material.

13. The tactical device of claim 9, wherein one of the barrel housing inner circumferential surface or the barrel outer circumferential surface further comprises one or more annular recesses formed therein that are each configured to receive a respective O-ring therein, wherein the O-ring provides a frictional fit between the barrel housing and the barrel such that the barrel moves axially with respect to the barrel housing when a sufficient force is exerted against the barrel first end.

14. The tactical device of claim 9, further comprising a safety mechanism, the safety mechanism comprising:

a. one or more recesses formed on an outer circumferential surface of the barrel housing;

b. one or more second O-rings, each one of the one or more second O-rings received in a respective one of the one or more recesses; and c. an accessory device comprising a body having:

i. a first end, ii. a second end, iii. a blind bore formed through the second end, and iv. at least one recess formed in an inner circumferential surface that defines a side wall of the blind bore, wherein the second end blind bore of the accessory body is configured to receive the barrel housing first end so that the at least one recess receives one of the one or more second O-rings.

15. The tactical device of claim 14, wherein the safety mechanism is configured to move the barrel axially with respect to the barrel housing into the first position and prevents the barrel from being moved into the second firing position until the accessory device is removed from the barrel housing.

16. The tactical device of claim 10, wherein the safety cap is moveable between a first position in which the barrel second end is prevented from engaging with the firing pin, and a second position in which the barrel second end can engage with the firing pin.

17. The tactical device of claim 9, further comprising a safety mechanism comprising:

a. a safety recess formed in the outer circumferential surface of the barrel housing;

b. an opening at a base of the safety recess that opens into the second through hole;

c. a safety comprising:

i. a safety disc, ii. a first stud extending from the safety disc, and iii. a second stud extending from the safety disc, d. a spring; and e. a safety cap moveably coupled to the second end of the barrel housing and moveable between a first safety off position and a second safety on position, wherein the safety cap comprises:

i. a first end defining an opening there through, ii. a second end, iii. an inner circumferential surface that defines a sidewall of a blind bore;

iv. a first flat surface formed in the inner circumferential surface of the safety cap that is formed at a first radial distance from a central axis that extends between the first end and the second end of the safety cap, and v. a second flat surface formed in the inner circumferential surface of the safety cap that is formed at a second radial distance from the central axis that is larger than the first radial distance, wherein:

the safety is received in the safety recess such that the second stud passes through the opening at the base of the safety recess, the spring is positioned intermediate the safety disc and the safety recess such that the spring biases the safety disc radially outward of the safety recess, the safety cap is moveable between:

a safety on first position in which the first flat surface engages with the first stud thereby pushing the safety radially inward such that the second stud is moved into the second through hole in the barrel housing thereby preventing the barrel from moving from the first position into the firing second position, and a second safety off position in which the second flat surface engages with the first stud thereby allowing the spring to bias the safety disc radially outward with respect to the safety recess so that the second stud exits the second through hole thereby allowing the barrel to move into the second firing position.

18. A tactical device comprising:

a. a barrel having a first end, a second end, a through hole that extends between the first end and a second and an outer diameter, wherein the second end is configured to removeably receive a cartridge in the barrel second end;

b. a barrel housing having a first end, a second end and a second through hole that extends between the first end and the second end, wherein the barrel housing has an inner diameter that is larger than the outer diameter of the barrel, and the barrel second end is configured to be inserted into the barrel housing first end and axially moveable with respect to the barrel housing;

c. a firing pin mounted in the barrel housing through hole proximate the barrel housing second end, the firing pin having a protrusion that extends toward the barrel housing first end; and d. a safety cap configured to be received on the barrel housing first end for maintaining the barrel in a first position in which the firing pin is spaced apart from the barrel second end, wherein the barrel is moveable with respect to the barrel housing between:

the first position in which the opening in the second end of the barrel is spaced apart from the protrusion on the firing pin, and a second firing position in which the barrel is moved axially with respect to the barrel housing such that the firing pin protrusion extends engages with a cartridge positioned in the barrel second end.

19. The tactical device of claim 18, wherein the safety means cap further comprises a flashlight.

20. The tactical device of claim 18, wherein the firing pin further comprises:

a. a cylindrical disc comprising the protrusion on a first end; and b. a threaded stud formed on a second end, wherein the threaded stud is configured to removeably couple the firing pin to the barrel housing second end.

* * * * *